US006142753A

United States Patent [19]

Bush et al.

[11] Patent Number: 6,142,753

[45] Date of Patent: Nov. 7, 2000

[54] SCROLL COMPRESSOR WITH ECONOMIZER FLUID PASSAGE DEFINED ADJACENT END FACE OF FIXED SCROLL

[75] Inventors: James W. Bush, Skaneateles; Gerald D. Reichert, North Syracuse, both of N.Y.

[73] Assignee: Carrier Corporation, Farmington, Conn.

[21] Appl. No.: 08/942,088

[22] Filed: Oct. 1, 1997

[51] Int. Cl.[7] ..... F04C 18/04

[52] U.S. Cl. ..... 418/15; 418/55.1

[58] Field of Search ..... 418/15, 55.1, 55.2, 418/55.6

[56] References Cited

U.S. PATENT DOCUMENTS

| | | | |
|---|---|---|---|
| 4,432,708 | 2/1984 | Hiraga et al. | 418/55.1 |
| 5,071,323 | 12/1991 | Sakashita et al. | 418/55.1 |
| 5,395,224 | 3/1995 | Caillat et al. | 418/55.6 |
| 5,666,015 | 9/1997 | Uchibori et al. | 310/261 |

FOREIGN PATENT DOCUMENTS

| | | | |
|---|---|---|---|
| 0283283A2 | 3/1988 | European Pat. Off. . | |
| 0508293A1 | 4/1992 | European Pat. Off. . | |
| 623184A | 1/1987 | Japan . | |
| 62-199984 | 9/1987 | Japan | 418/55.1 |
| 412183A | 1/1992 | Japan . | |
| 5-157069 | 6/1993 | Japan | 418/55.6 |
| 5-248370 | 9/1993 | Japan | 418/55.6 |
| 07103152A | 4/1995 | Japan . | |

OTHER PUBLICATIONS

Translation of Japanese Publication 7–103152.
European Search Report (EP 98 30 7214).
European Patent Abstract (98307214.1).
Japanese Patent Abstract (07103152; Apr. 18, 1995).
Japanese Patent Abstract (61169691; Jul. 31, 1986).

*Primary Examiner*—John J. Vrablik
*Attorney, Agent, or Firm*—Carlson, Gaskey & Olds

[57] ABSTRACT

An improved scroll compressor utilizes a crossing economizer passage which is defined between an outer end face of the fixed scroll and a mating end face of an overlying cover. Since the economizer passage is formed in a face which is exposed before assembly, it is relatively easy to machine the complex crossing passage into the end face. The passage is machined into the end face, and the cover and fixed scroll are secured together closing the passage. The invention simplifies formation of the relatively complex economizer crossing passage.

18 Claims, 3 Drawing Sheets

SCROLL COMPRESSOR WITH ECONOMIZER FLUID PASSAGE DEFINED ADJACENT END FACE OF FIXED SCROLL

BACKGROUND OF THE INVENTION

The present invention discloses a scroll compressor wherein a complex economizer passage is easily milled into an end face of either the fixed scroll member or a covering valve plate.

Scroll compressors are becoming widely utilized in refrigerant compression applications. As known, a scroll compressor essentially comprises fixed and orbiting scrolls that have interfitting spiral wraps which define a plurality of compression passages. The orbiting scroll moves relative to the fixed scroll to entrap and close chambers of fluid which are then compressed towards a central discharge port in the fixed scroll.

One challenge with refrigerant compression applications is to increase the heat transfer capacity of the refrigeration cycle. One known technique for increasing heat transfer capacity is the use of an economizer circuit which includes entry ports in the compressor. Economizer entry ports communicate intermediate pressure fluid into a scroll compression chamber at a point just after the chamber is closed. By injecting additional fluid into the chamber, the economizer entry ports increase the volume of compressed fluid.

The design of the scroll compressor wraps is quite complex. The points in the cycle at which the two scroll compression wraps come together to enclose a chamber varies with the particular scroll design. Thus, there is a need to accurately position the economizer entry port at a desired optimum position.

In the prior art, the economizer entry ports have been communicated to suction fluid through passages that are drilled or machined across an intermediate plane within the fixed scroll. The economizer entry port is then drilled into the base of the fixed scroll to communicate with the crossing economizer passages.

With this prior art, the machining of the economizer passages into the fixed scroll has been quite time consuming and complex. Further, once an optimum position for the economizer entry ports has been selected, the shape of the crossing passage has sometimes been quite complex. It is very difficult to precisely control the exact desired shape of the economizer passages and achieve a complex passage.

In some applications it may be desirable to have economizer entry ports on both sides of the central axis of the fixed scroll. In the known art, this has proven difficult to achieve since the discharge port is typically directly in the center of the fixed scroll. Thus, the crossing economizer passages must somehow move around the central discharge port. With the cross-drilled passages through the fixed scroll, this has been somewhat difficult to achieve.

SUMMARY OF THE INVENTION

In a disclosed embodiment of this invention, economizer passages are formed between an outer end face of the fixed scroll and a cover secured to the fixed scroll outer end face. Complex economizer passages can be easily machined into either the end face of the fixed scroll, or into a facing end face of the cover. Thus, the provision of complex economizer passages is simplified over the known art.

In a preferred embodiment of this invention, an economizer passage extends for a relatively great area when compared to an economizer entry port which communicates with the economizer passage. The economizer entry ports extend through the fixed scroll and into compression chambers defined between the fixed and orbiting scroll. Suction pressure fluid communicates through a port that extends through the side of the fixed scroll, and then through the fixed scroll to the economizer passage.

In one preferred embodiment, the economizer passage is machined into the outer end face of the fixed scroll. A machine tool has complete access to the end face prior to assembly of the scroll compressor. Thus, very complex shapes may be easily machined into the end face. In a most preferred embodiment, the economizer passage is generally v-shaped and extends between two economizer entry ports. Preferably, a first economizer entry port is positioned adjacent a first end of the economizer passage, and a second economizer entry port is positioned near an opposed end. The two economizer entry ports are preferably spaced on opposed sides of a discharge port which is generally centered on a center axis of the fixed scroll.

The cover preferably has a generally flat surface that closes the economizer passage to define a sealed, fluid-tight chamber. The cover is preferably bolted to the fixed scroll.

In a second embodiment, the cover has the economizer passage machined into an end face. The economizer entry ports are cut through the fixed scroll and extend from an end face of the fixed scroll into the compression chambers. The cover is bolted to the fixed scroll to define fluid-tight chambers as in the first embodiment.

In a method according to this invention, the economizer passage is machined into one of the cover end face or the fixed scroll end face. In this way, complex economizer passages may be easily manufactured. The cover is then attached to the fixed scroll. The scroll members are then assembled together.

These and other features of the present invention can be best understood from the following specification and drawings, of which the following is a brief description.

DETAILED DESCRIPTION OF A PREFERRED EMBODIMENT

Figure 1:
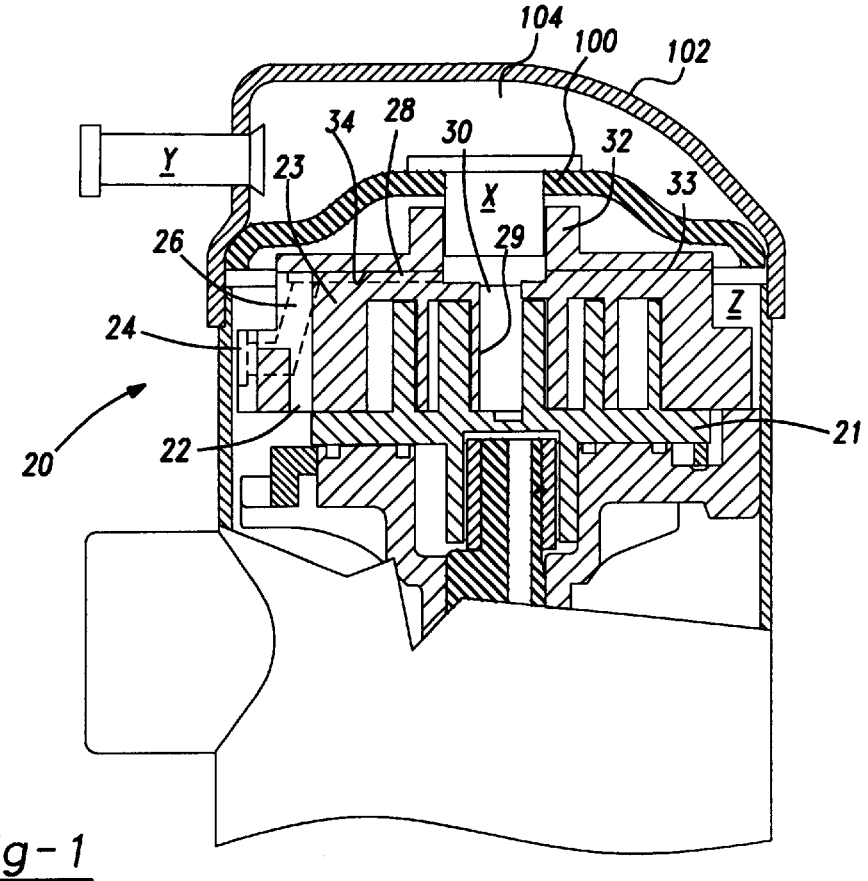
FIG. 1 is a cross-sectional view through a first embodiment scroll compressor.

FIG. 1 shows a first embodiment scroll compressor 20 incorporating an inlet port 22 leading through non-orbiting, which is shown as a fixed scroll member 23. An economizer inlet port 24 leads to an upwardly extending economizer passage 26. An orbiting scroll 21 is positioned opposite fixed scroll 23. A crossing economizer passage 28 communicates passage 26 to economizer entry ports as will be explained below. A central discharge port 30 extends through the fixed scroll 23, as known. A cover 32 is bolted to an outer end face 33 of the fixed scroll 23, and closes off the crossing economizer passage 28. Although passage 26 is shown in the fixed scroll, it is also known to have the supply extend through cover 32.

As is clear from FIG. 1, a plate 100 separates a suction chamber from a discharge chamber above the cover 32. As can be seen from the communication of the inlet 22, the cover 32 and the base of the orbiting scroll are in a suction pressure chamber. An end cap 102 defines a discharge pressure chamber 104 between the plate 100 and the cap 102. The same can be clearly seen from the FIG. 6 embodiment, wherein the cover 72 clearly defines a suction chamber on one side and a discharge chamber on the other.

Figure 2:
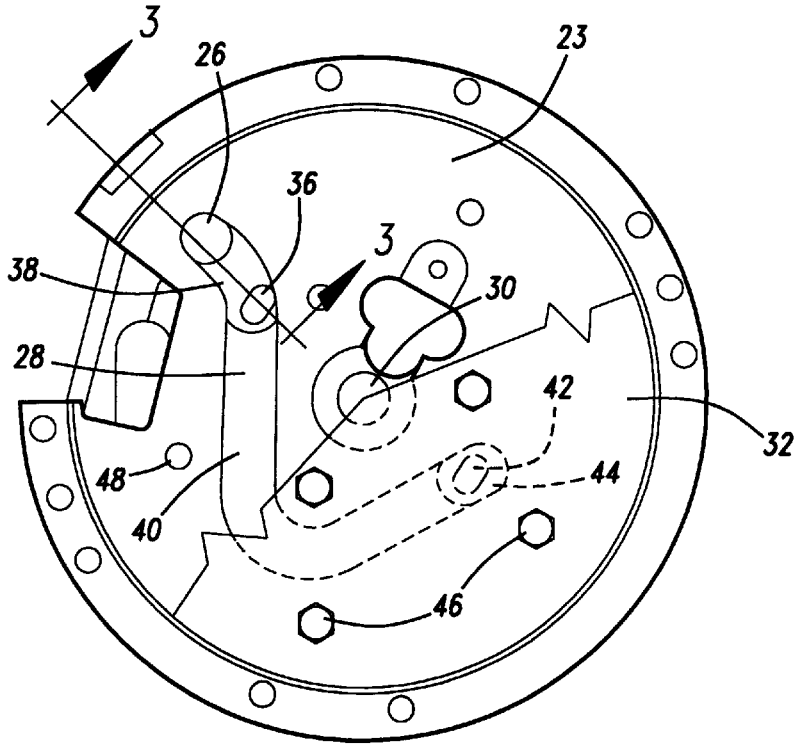
FIG. 2 is a partially cutaway end view of the first embodiment scroll compressor.

As shown in FIG. 2, passage 26 communicates with the economizer crossing passage 28. A first economizer entry port 36 is positioned in a relatively deep entrance portion 38. Crossing portion 40 is generally v-shaped and extends from portion 38 to an opposed entry port 42 which is also surrounded by an entrance portion 44. The relatively deep entrance portions 38 and 44 are deeper than portion 40, to ensure there is no restriction to fluid entering the economizer entry ports 36 and 42.

As explained above, the design of scroll compressors may dictate precise positions for economizer entry ports 36 and 42. Thus, the crossing economizer passage 40 may take a somewhat complex shape. As shown in FIG. 2, the entry ports 36 and 42 are positioned on opposed sides of the central axis defined by the discharge port 30. In the prior art, such a passage would have to have been provided by drilling at least two intersecting cross holes through the body of the fixed scroll member. This would be complex, and would sometimes limit the ability of a designer to achieve precise positions.

The cover 32 closes off the passage 28. Cover 32 is bolted 46 to the fixed scroll 23 through bolt holes 48.

As shown in FIG. 2, the crossing passage 28 including the portions 38, 40 and 44 is much greater than the area of the entry ports 36 and 42. Stated another way, the entry ports 36 and 42 are relatively small, and the connecting passage extends for a relatively great area and distance. This relatively great distance has made the cross-drilling required by the prior art difficult.

Figure 3:
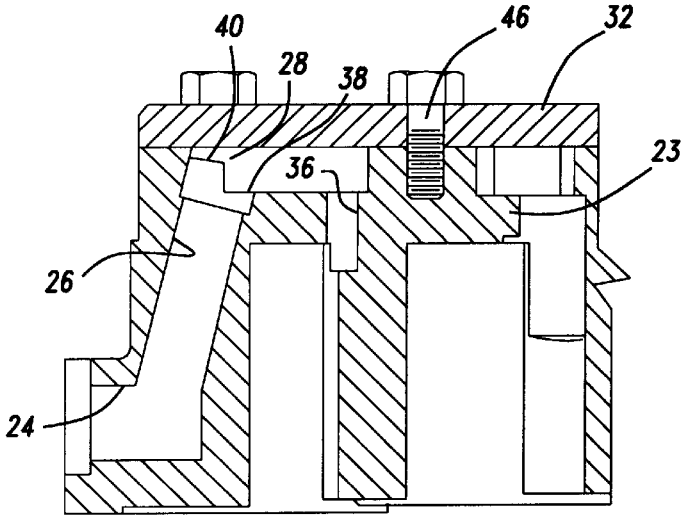
FIG. 3 is a cross-sectional view along line 3—3 as shown in FIG. 2.

As shown in FIG. 3, the entry port 36 has entrance area 38 which is relatively deeper than the remainder 40 of the crossing passage 28. The bolt 46 secures the cover 32 to the fixed scroll 23.

Figure 4:
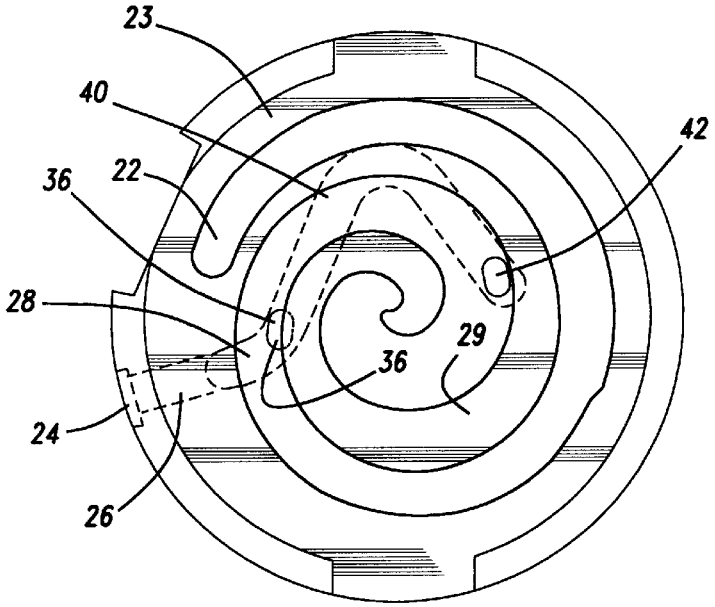
FIG. 4 is an end view of a fixed scroll according to the first embodiment.

As shown in FIG. 4, the entry ports 36 and 42 are positioned at desired locations in the fixed scroll 23. The designer is able to precisely position the entry ports 36 and 42, as the crossing passage 28 is easily machined into the end face 33 of the fixed scroll 23.

Figure 5:
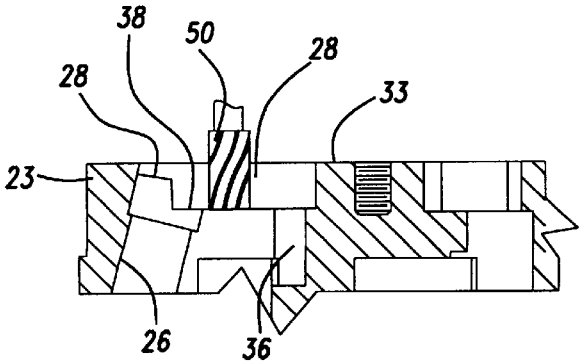
FIG. 5 shows a manufacturing step in manufacturing the first embodiment.

As shown in FIG. 5, a cutting tool 50 machines the crossing passage 28 into end face 33. The cutting tool 50 has easy access to end face 33, and thus precise machining of complex passages is achieved easily. The upward passage 26 and the entry port 36 (and 42) may be easily machined into the end face.

Figure 6:
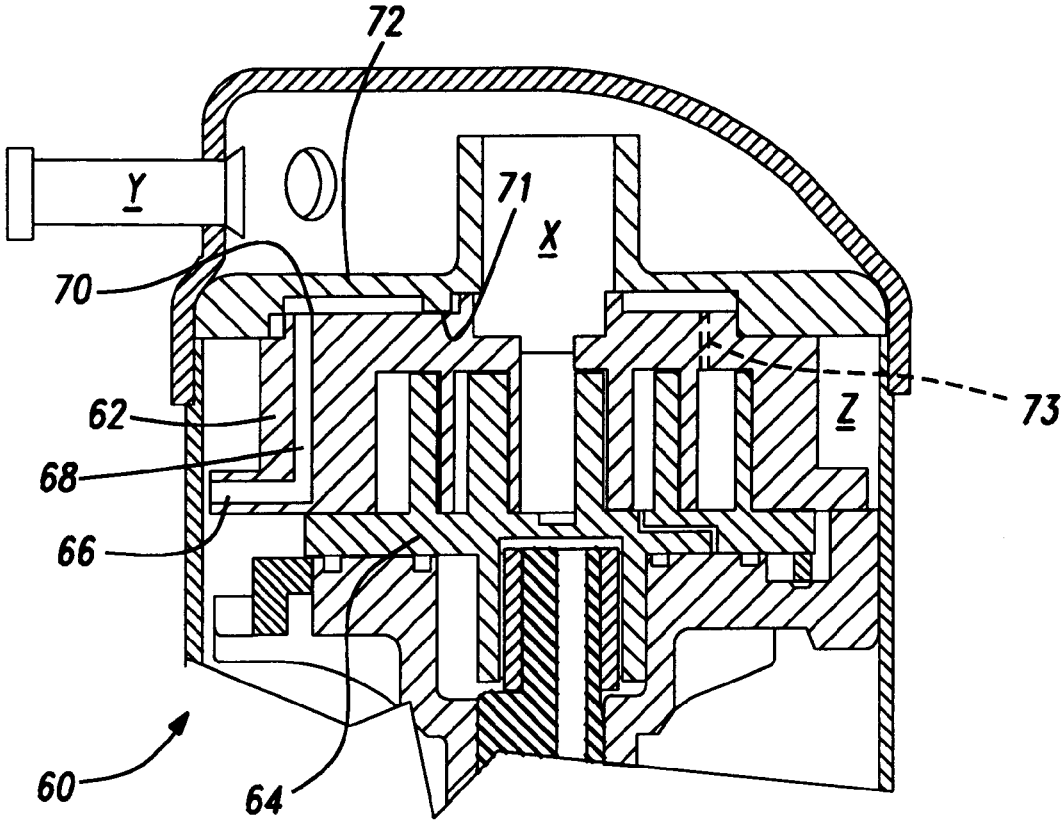
FIG. 6 shows a second embodiment scroll compressor according to this invention.

FIG. 6 shows a second embodiment 60, with fixed scroll 62 positioned opposite orbiting scroll 64. An economizer inlet port 66 extends to an upwardly extending passage economizer 68. Passage 68 extends to a crossing passage 70 formed in the end face 71 of the cover 72. Passage 70 communicates to an economizer entry port 73, which extends through the fixed scroll 62. The passage 70 may be machined as in the first embodiment, since the end face of the cover 72 is accessible. The passage 70 preferably communicates to two entry ports, although only a single entry port is shown in FIG. 6. Further passage 70 is often similarly shaped to the shape of passage 28. The cover 72 is preferably bolted to the fixed scroll 62 as in the prior embodiment.

Preferred embodiments of this invention have been disclosed, however, a worker of ordinary skill in the art would recognize that certain modifications would come within the scope of this invention. For that reason, the following claims should be studied to determine the true scope and content of this invention.

What is claimed is:

1. A scroll compressor comprising:

an orbiting scroll having a base with a generally spiral scroll wrap extending from said base;

a non-orbiting scroll having a base with a generally spiral scroll wrap extending from said base, said wraps of said non-orbiting and orbiting scrolls interfitting to define a plurality of compression chambers, said non-orbiting scroll base having an outer end face facing away from said wraps;

a cover secured to said outer end face of said non-orbiting scroll base;

an inlet port for delivering a fluid to be compressed to a radially outer location between said non-orbiting and orbiting scroll wraps; and an economizer passage for communicating with a source of fluid and delivering fluid to locations spaced radially inwardly of said inlet port, said economizer passage including a crossing passage defined between said outer end face of said non-orbiting scroll base, and said cover, said cover and said non-orbiting scroll base being positioned in a suction pressure chamber.

2. A scroll compressor as recited in claim 1, wherein said crossing passage is formed in said outer end face of said non-orbiting scroll base, and economizer entry ports extend through said non-orbiting scroll, said crossing passage communicating with said economizer entry ports.

3. A scroll compressor as recited in claim 1, wherein said crossing passage is formed in an end face of said cover, and an economizer entry port communicates with said crossing passage and extends through said non-orbiting scroll.

4. A scroll compressor as recited in claim 1, wherein said non-orbiting scroll is a fixed scroll.

5. A scroll compressor as recited in claim 1, wherein said cover and said non-orbiting scroll base are positioned on a suction pressure side of a plate which separates the scroll compressor into a suction and discharge pressure chamber.

6. A scroll compressor as recited in claim 1, wherein said crossing passage communicates fluid to economizer entry ports, said economizer entry ports extending through said non-orbiting scroll base to communicate to said compression chambers.

7. A scroll compressor as recited in claim 6, wherein there are two economizer entry ports, and a single crossing passage communicates to both said economizer entry ports.

8. A scroll compressor as recited in claim 7, wherein said crossing passage is generally v-shaped, and said two economizer entry ports are positioned on opposed sides of a central axis of said non-orbiting scroll.

9. A scroll compressor as recited in claim 7, wherein an economizer inlet port extends into a side wall of said non-orbiting scroll, and then extends through said non-orbiting scroll to said outer face to communicate to said crossing passage.

10. A scroll compressor as recited in claim 7, wherein said crossing passage is formed in said outer end face of said non-orbiting scroll, and said cover is secured to said outer end face to close said crossing passage.

11. A scroll compressor as recited in claim 10, wherein said crossing passage is generally v-shaped, and said two economizer entry ports are positioned on opposed sides of a central axis of said non-orbiting scroll.

12. A scroll compressor as recited in claim 10, wherein said cover is bolted to said non-orbiting scroll.

13. A scroll compressor as recited in claim 10, wherein an economizer inlet port extends into a side wall of said non-orbiting scroll, and then extends through said non-orbiting scroll to said outer face to communicate to said crossing passage.

14. A scroll compressor as recited in claim 1, wherein an economizer inlet port extends through a side wall of said non-orbiting scroll and then extends through said non-orbiting scroll to communicate fluid to said economizer crossing passage.

15. A scroll compressor as recited in claim 14, wherein said crossing passage is formed into an end face of said cover, and economizer entry ports extend through said non-orbiting scroll, said crossing passage communicating with said economizer entry ports.

16. A scroll compressor comprising:

an orbiting scroll having a base and a generally spiral scroll wrap extending from said base;

a non-orbiting scroll having a base with a generally spiral scroll wrap extending from said base, said spiral wraps of said non-orbiting and orbiting scrolls interfitting to define a plurality of compression chambers, an outer end face of said non-orbiting scroll base defined facing away from said wraps;

an inlet for delivering a fluid to be compressed to a radially outer location between said non-orbiting and orbiting scroll wrap;

an economizer passage for communicating with a source of fluid and delivering fluid to locations spaced radially inwardly of said inlet port, said economizer passage including a crossing passage defined in said outer end face of said non-orbiting scroll base, said crossing passage communicating fluid to at least two economizer entry ports, said economizer entry ports extending through said non-orbiting scroll base to communicate to said compression chambers, said crossing passage extending for a greater surface area then said economizer entry ports, said crossing passage being generally V-shaped, and said two economizer entry ports being positioned on opposed sides of a central axis of said non-orbiting scroll such that one of said economizer entry ports is positioned adjacent to each of two ends of said crossing passage, an economizer inlet port extending through a sidewall of said non-orbiting scroll, and then extending through said non-orbiting scroll to communicate to said crossing passage; and a cover having a generally planar mating face abutting said outer end face of said non-orbiting scroll to close said crossing passage, said cover being secured to said non-orbiting scroll, said cover and said non-orbiting scroll base being positioned in a suction pressure chamber.

17. A scroll compressor as recited in claim 16, wherein said non-orbiting scroll is a fixed scroll.

18. A scroll compressor as recited in claim 16, wherein said cover and said non-orbiting scroll base are positioned on a suction pressure side of a plate which separates the scroll compressor into a suction and discharge pressure chamber.

* * * * *